United States Patent [19]

McClellan, Jr.

[11] Patent Number: 4,510,769

[45] Date of Patent: Apr. 16, 1985

[54] THERMALLY INSULATING DEVICE FOR A BEVERAGE-CONTAINING BOTTLE

[76] Inventor: Robert D. McClellan, Jr., 326 Olive Ave., Horsham, Pa. 19044

[21] Appl. No.: 597,073

[22] Filed: Apr. 5, 1984

[51] Int. Cl.[3] ..... F25D 3/08

[52] U.S. Cl. ..... 62/457; 62/372; 215/12 R

[58] Field of Search ..... 215/12 R; 62/457, 371, 62/372, 529, 530

[56] References Cited

U.S. PATENT DOCUMENTS

| | | | |
|---|---|---|---|
| 631,182 | 8/1899 | Seelinger | 215/12 R |
| 776,356 | 11/1904 | Selzler | 215/12 R |
| 978,892 | 12/1910 | Janssen | 215/12 R |
| 3,120,319 | 2/1964 | Buddrus | 215/13 |
| 3,229,840 | 1/1966 | Filleul | 215/12 R |
| 3,365,911 | 1/1968 | Stoner et al. | 62/457 |
| 3,467,243 | 9/1969 | Butcher | 215/12 R |
| 3,766,975 | 10/1973 | Todd | 62/457 X |
| 4,281,520 | 8/1981 | Norwood | 62/372 |
| 4,338,795 | 7/1982 | House, Jr. | 62/372 |

*Primary Examiner*—Lloyd L. King

*Attorney, Agent, or Firm*—Norman B. Rainer

[57] ABSTRACT

An adjustable container is provided for maintaining a long-necked beverage-containing bottle at a low temperture. The container is comprised of an upper shell member having a contour generally similar to the shape of the bottle and having an upper opening of small diameter, and a lower opening of large diameter. The interior wall of the upper shell member carries a layer of thermally insulative material. A resilient annular gasket disposed within the upper shell member adjacent its upper opening is adapted to make sealing engagement with a bottle which may be mounted into the upper shell member to an extent which causes the neck of the bottle to protrude through the upper opening. A base member, of cup-shaped configuration is adapted to accommodate the bottom of the bottle and threadably engage the upper shell member to force the bottle into tight engagement with the gasket.

6 Claims, 2 Drawing Figures

THERMALLY INSULATING DEVICE FOR A BEVERAGE-CONTAINING BOTTLE

BACKGROUND OF THE INVENTION

This invention concerns a container device, and more particularly relates to a re-usable thermally insulative container adapted to accommodate a single beverage-containing long-necked bottle.

Beverages such as soda pop, beer, juices, and some wines are generally intended to be consumed in a coöled state, and are usually packaged in long-necked bottles carrying a single normal serving of the beverage. Once the bottle is opened, its contents are consumed, and the empty bottle is discarded.

Although the beverage bottles may be kept cold in large refrigerated compartments or in ice chests, the bottles soon become warm upon removal from such cooling enclosures. It is of considerable interest therefore to be able to prolong the duration of time a bottled beverage will stay cold following its removal from a cooling source.

Several devices have earlier been reported for maintaining a single beverage bottle at a low temperature. For example, U.S. Pat. No. 4,281,520 to Norwood describes two half shells which strap around a bottle. Coolant is circulated through the half shells to maintain the bottle at a low temperature. U.S. Pat. No. 3,120,319 to Buddrus discloses a thermally insulative container of fixed size comprising a lower member in which a bottle is seated, and a threaded closure cap interactive with the upper extremity of the lower member. Although the Buddrus device appears to be effective in principle, the container appears to be of considerable size, and engenders the inconvenience of having to separately handle the lower member and closure cap before gaining access to the beverage bottle with its own closure cap.

It is accordingly an object of the present invention to provide a thermally insulative container of small size for accommodating a single long-necked beverage bottle.

It is another object of this invention to provide a container as in the foregoing object which enables liquid to be directly dispensed from the bottle.

It is a further object of the invention to provide a container of the aforesaid nature capable of adjustment to accommodate bottles of different sizes.

It is still another object of the present invention to provide a thermally insulative container of the aforementioned characteristics of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an improved adjustable container which comprises an upper member and threadably interengaged base member. The upper member is elongated about a center axis of symmetry and is comprised of an outer shell having interior and exterior walls and of circular cross section in planes perpendicular to said axis, a layer of thermally insulative material of uniform thickness disposed upon said interior wall, an open upper extremity provided with an inwardly disposed resilient gasket, and an open lower extremity of larger diameter than said upper extremity and provided with a spiral threading. The contour of the outer shell is such as to have been generated by a curved line revolved at a fixed distance about said axis.

The base member is a cup-shaped structure comprised of an outer shell of circular cylindrical configuration having interior and exterior walls, having an open upper extremity, and a lower extremity which is closed by a flat panel having interior and exterior walls. A layer of thermally insulative material of uniform thickness is disposed upon the interior walls of said outer shell and flat panel. The upper extremity of the base member is provided with a spiral threading adapted to engage the complementary spiral threading of the upper member.

In a preferred embodiment, the spiral threading of the upper member is disposed upon the exterior wall of the outer shell, and the spiral threading of the base member is disposed upon the interior wall of its outer shell. The insulative material is preferably a closed cell foam of a synthetic polymer material such as polystyrene or polyurethane. The outer shells are preferably fabricated of plastics amenable to injection or blow molding.

By virtue of the threaded interengagement of the upper and base members, the overall height of the container can be adjusted. Not only does such adjustment permit the container to accommodate bottles of different sizes, but its contracting movement causes the resilient gasket to securely grip the neck of a bottle to produce an airtight seal therewith. The seal thereby produced forms a stagnant air layer between the bottle and the insulative material which enhances the thermally insulative efficiency of the container.

The expressions "long-necked" or "beverage" bottles, as used herein denote a bottle having a cylindrical elongated lower body portion and a tapered shoulder leading to an upper neck portion of reduced diameter, said neck portion terminating in an open circular extremity capable of receiving a removable sealing cap.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
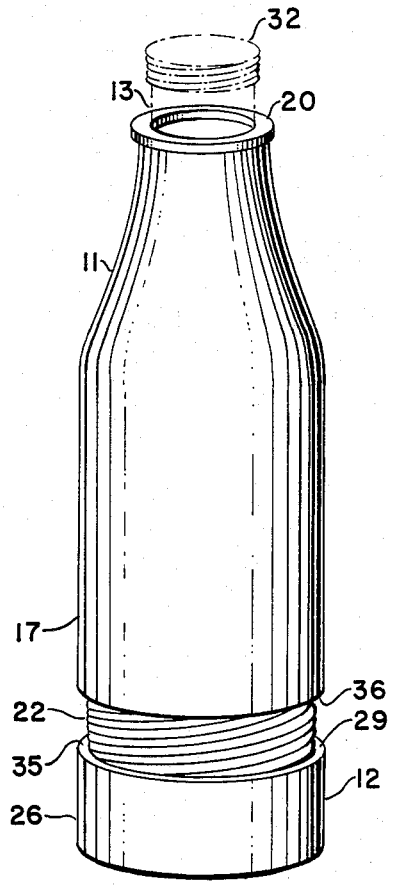
FIG. 1 is a perspective view of an embodiment of the container of this invention.
Figure 2:
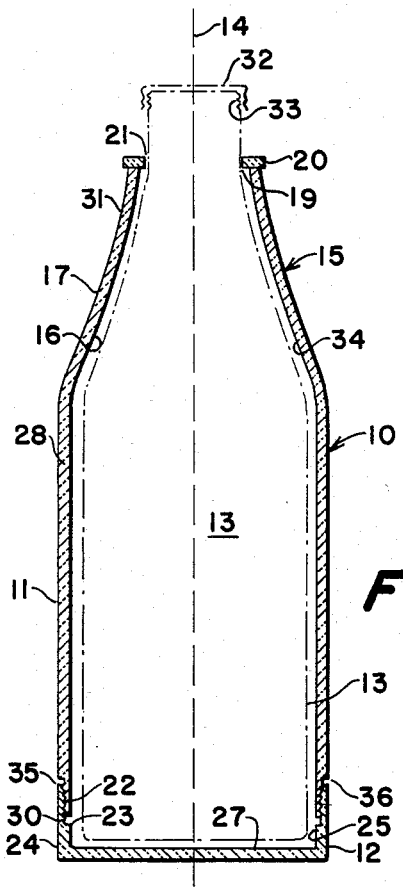
FIG. 2 is a vertical sectional view of the container of FIG. 1.

Referring to FIGS. 1 and 2, a container 10 of the present invention, comprising upper member 11 and threadably interengaged base member 12 is shown embracing beverage bottle 13. Said upper member is elongated about center axis of symmetry 14 and is comprised of outer shell 15 having interior wall 16 and exterior wall 17, and thermally insulative material 18 attached as a layer of uniform thickness to interior wall 16. The outer shell is contoured as a surface of revolution generated about axis 14, and accordingly has a circular cross-section in planes perpendicular to said axis. The upper member has an open upper extremity 19 and an associated resilient gasket or washer 20 having a circular opening 21 which is inwardly disposed with respect to outer shell 15. Spiral threading 22, adjacent open lower extremity 23 of said upper member, is recessed into exterior wall 17 of outer shell 15.

Base member 12 is of cup-like configuration, comprised of circular cylindrical outer shell 24 having interior wall 25 and exterior wall 26, and flat bottom panel 27 integral with outer shell 24. Thermally insulative material 28 is adhered as a layer of uniform thickness to the interior surfaces of said outer shell and bottom panel. The upper extremity 29 of said base member is open. Spiral threading 30, adjacent said open upper extremity, is recessed into interior wall 25 of outer shell 24. The configuration of threading 30 is such as to mesh with threading 22 of said upper member.

In use, a beverage bottle is inserted bottom down into said base member. The upper member is then drawn over the top of the bottle and pressed downwardly until the circular opening 21 of gasket 20 seats upon the tapered portion 31 of said bottle. In such position, the mouth 32 of the bottle and its closure cap 33 will protrude above upper member 11. The threading of base member 12 is then caused to engage the threading of said upper member, and with rotation of one member with respect to the other, both members are drawn into closer engagement, causing the gasket to firmly grip the bottle. Such action forms a stagnant air envelope 34 between the sidewall of the bottle and the layer of insulative material 28 of said upper member.

In a preferred mode of construction, the upper lip 35 of said lower member is caused to make a flush fit with shoulder 36 adjacent the threading of said upper member. In this manner of construction, a smooth outer contour of the container is maintained in those instances when the threading of both members are in full interengagement. The lengths of both threaded portions, measured in the direction of axis 14, is between about 1 and 3 inches. Such configuration enables the insulating device to accommodate bottles of various heights. The exterior wall of the member is preferably of smooth texture and adapted to contain printed indicia. The expression "wall", as used herein, is to be construed as a surface of an impervious rigid structure.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An adjustable container for maintaining a long-necked beverage containing bottle at a low temperature comprising:

(a) an upper member elongated about a center axis of symmetry and comprised of an outer shell of circular cross section in planes perpendicular to said axis and having interior and exterior surfaces, a layer of thermally insulative material of uniform thickness disposed upon said interior surface, an open upper extremity provided with an inwardly disposed resilient gasket of annular contour, and an open lower extremity of larger diameter than said upper extremity and provided with spiral threading, and (b) a base member of cup-shaped structure comprised of an outer shell of circular cylindrical configuration having interior and exterior surfaces and having a lower extremity and an open upper extremity, a flat panel serving to close said lower extremity and having interior and exterior surfaces, a layer of thermally insulative material of uniform thickness disposed upon said interior surfaces, and spiral threading disposed upon said outer shell adjacent its upper extremity and adapted to engage the complementary threading of said upper member whereby, (c) when said base member threadably engages said upper member about an intervening long-necked bottle, rotation of one member with respect to the other causes both members to be drawn into closer engagement, causing said gasket to firmly grip the bottle and thereby form a stagnant air envelope between the bottle and the thermally insulative material.

2. The adjustable container of claim 1 wherein a lower portion of said upper member has a circular cylindrical configuration, the diameter of which matches the diameter of the outer shell of said base member.

3. The adjustable container of claim 2 wherein the spiral threading of said upper member is disposed upon the exterior surface of its outer shell, and the spiral threading of said base member is disposed upon the interior surface of its outer shell.

4. The adjustable container of claim 2 wherein the thermally insulative material is comprised of a closed cell synthetic polymer material.

5. The adjustable container of claim 2 wherein the outer shell and flat panel of the base member are portions of an integral structure.

6. The adjustable container of claim 2 wherein the inside diameter of the resilient gasket is large enough to permit passage therethrough of the mouth of a long-necked bottle.

* * * * *